US008028410B2

(12) United States Patent
Thompson

(10) Patent No.: US 8,028,410 B2
(45) Date of Patent: Oct. 4, 2011

(54) GAS TURBINE REGENERATOR APPARATUS AND METHOD OF MANUFACTURE

(76) Inventor: Randy Thompson, Stephenville, TX (US)

( * ) Notice: Subject to any disclaimer, the term of this patent is extended or adjusted under 35 U.S.C. 154(b) by 408 days.

(21) Appl. No.: 12/428,798

(22) Filed: Apr. 23, 2009

(65) Prior Publication Data

US 2010/0139900 A1 Jun. 10, 2010

Related U.S. Application Data

(60) Provisional application No. 61/120,504, filed on Dec. 8, 2008.

(51) Int. Cl.
*B21D 53/04* (2006.01)
*F28F 3/08* (2006.01)

(52) U.S. Cl. ..... 29/890.039; 60/39.511; 165/167; 165/175; 165/178; 165/906

(58) Field of Classification Search ..... 165/167, 165/175, 178, 906; 60/39.511; 29/890.039
See application file for complete search history.

(56) References Cited

U.S. PATENT DOCUMENTS

| | | | | |
|---|---|---|---|---|
| 3,042,382 | A * | 7/1962 | Hryniszak | 165/167 |
| 3,507,115 | A | 4/1970 | Wisoka | |
| 3,590,917 | A | 7/1971 | Huber | |
| 3,780,800 | A | 12/1973 | Flower | 165/166 |
| 4,113,007 | A | 9/1978 | Flower et al. | 165/81 |
| 4,134,195 | A * | 1/1979 | Jacobsen et al. | 165/167 |
| 4,229,868 | A | 10/1980 | Kretzinger | 29/157 |
| 4,263,964 | A | 4/1981 | Masai et al. | 165/67 |
| 4,291,752 | A | 9/1981 | Bridgnell | 165/78 |
| 4,291,754 | A * | 9/1981 | Morse et al. | 165/167 |
| 4,377,025 | A | 3/1983 | Masai et al. | 29/434 |
| 4,987,955 | A * | 1/1991 | Bergqvist et al. | 165/167 |
| 7,065,873 | B2 * | 6/2006 | Kang et al. | 165/906 |
| 7,195,057 | B2 | 3/2007 | Blomgren | 165/81 |
| 2002/0050347 | A1 * | 5/2002 | Hainley et al. | 165/167 |
| 2007/0084592 | A1 | 4/2007 | Hendrix et al. | 165/166 |

FOREIGN PATENT DOCUMENTS

| | | | |
|---|---|---|---|
| JP | 62013995 A | * | 1/1987 |
| JP | 62013996 A | * | 1/1987 |
| JP | 62013997 A | * | 1/1987 |

* cited by examiner

*Primary Examiner* — Leonard Leo
(74) *Attorney, Agent, or Firm* — Charles D. Gunter, Jr.

(57) ABSTRACT

A regenerator core for use in a gas turbine regenerator has integral manifold openings formed in the tube plates used to make up the core and has special reinforcing elements which provide high pressure containment in critical portions of the plate-and-fin heat exchanger construction. The reinforcing elements include a series of hoops of U-shaped cross section which are used to bridge the juncture lines of the heat exchanger manifolds. An outer channel region of the hoops is provided with a reinforcing strip of gusset material. The hoops with their reinforcing strips provide structural reinforcement in the region between the manifolds and the conventional side bar reinforcing members in the central core section.

11 Claims, 6 Drawing Sheets

GAS TURBINE REGENERATOR APPARATUS AND METHOD OF MANUFACTURE

CROSS-REFERENCE TO RELATED APPLICATIONS

The present application claims priority from the earlier filed provisional application Ser. No. 61/120,504 filed Dec. 8, 2008, entitled "Gas Turbine Regenerator Apparatus and Method of Manufacture," by the same inventor.

BACKGROUND OF THE INVENTION

1. Field of the Invention

This invention relates to methods and materials for manufacturing a specialized type of plate and fin type heat exchanger and, in particular, to a method and materials for manufacturing a gas turbine regenerator heat exchanger.

2. Description of the Prior Art

The present invention deals with a particular type of plate and fin heat exchanger known in the relevant arts as the "gas turbine regenerator." This type of heat exchanger has been developed for use with large gas turbines for improving turbine efficiency and performance while reducing operating costs. Heat exchangers of the type under discussion are typically referred to as either "recuperators" or as "regenerators." One typical application of such units is in conjunction with gas turbines employed in gas pipe line compressor drive systems.

In the typical gas turbine power plant application, the regenerator is used to heat compressor discharge air prior to its entry into the combustion chambers, thereby reducing the amount of fuel necessary to bring the combustion gases to the required operating temperatures. Heat is transferred to the compressor discharge air from hot turbine exhaust gases which pass through the regenerator in heat transfer relation with the compressor discharge air. The regenerator includes alternating stacked air and gas channels of the plate-fin type to effect the heat transfer.

Gas turbine regenerators of the type under consideration have included box-like structures having plate-fin tube banks with the entire regenerator banded together by tie straps which interconnected structural end frames. Compressor discharge air, at the relatively high operating pressures encountered, tends to warp or bow the end frame structures of these devices, thereby presenting a point of potential material failure. Also, the design of the prior art units have, to some extent, been limited in their recommended operating temperature ranges by virtue of the materials employed in their fabrication as well as by the fabricating techniques which were employed.

For example, the previously used compression-fin designs at times developed unbalanced internal pressure-area forces in a regenerator of suitable size. Unbalanced forces of this type tended to split the regenerator core structure apart during operation. More recently, technology has advanced so that the internal pressure forces are more evenly balanced. However, even with the advances which have been made in materials and manufacturing techniques, the changes in dimension of the overall unit due to thermal expansion and contraction become significant and must be taken into account in the overall design. These thermal size changes must be accommodated in some fashion to prolong the useful life of the regenerator. The problem is exaggerated by the fact that the regenerator must withstand a lifetime of thousands of heating and cooling cycles due to the operating mode of the associated turbo-compressor which is often started and stopped repeatedly.

U.S. Pat. No. 3,866,674, issued Feb. 18, 1975, assigned to General Electric Company, shows a regenerator design which is typical of the prior art in that the plate and fin tube banks were joined at either of two opposite ends to a cylindrical inlet and outlet plenum, respectively. The air inlet and outlet plenums were formed with semi-circular slotted openings disposed along the longitudinal axis of each plenum. The pressure tubes making up the tube banks also had semi-circular end regions which were received within the openings in the plenums where they were welded in place. The junctions between the tube sheets and cylindrical plenums presented potential failure points in the design when subjected to the extreme temperature and pressure conditions discussed above.

U.S. Pat. No. 4,229,868, issued Oct. 28, 1980, assigned to The Garrett Corporation, was an improvement on the above plenum and tube sheet design. This regenerator was constructed of a plurality of formed plates and fins brazed together into a complete unit comprising manifolds and a heat exchanging core in a single counter-flow device. The respective end portions of the heat exchanger plates are formed with a peripheral flange which, when joined with the corresponding flange of an adjacent formed tube plate, provides a boundary seal for containing the air fin passages provided by the thus-joined pair of heat exchanger plates. Each end portion of the formed tube plate had an opening encircled by a collar portion, thus defining a manifold section through the plate. The collar portion was cut back along the side facing the core portion so as to provide communication between the manifold section and the air fin passages. The formed tube plate also had a ring offset from the plane of the plate and extending about the manifold opening. This ring had a flat base portion which served to provide spacing between the joined plates for the gas fin passages and to seal the manifold sections of the joined heat exchanger plates from the gas passages.

Rising fuel costs in recent years have dictated that gas turbine power plants operate with increased thermal efficiency, and new operating methods require a regenerator that will operate more efficiently at higher temperatures while possessing the capability of withstanding thousands of starting and stopping cycles without leakage or excessive maintenance costs. As a result, a need continues to exist for improvements to the regenerator designs which are used with gas turbines employed in gas pipe line compressor drive systems, as well as in other industrial applications.

A need continues to exist for an improved regenerator design in which potential weak points which would be subject to rupture from internal pressure forces are eliminated.

A need also exists for such an improved design which features a brazed, stainless steel core which allows for greater efficiency and ultimately higher cost-savings than other types of regenerators currently in the marketplace.

SUMMARY OF THE INVENTION

The present invention has as its object to improve the structural integrity of the core element of a particular type of plate and fin heat exchanger known as a gas turbine regenerator core. In the method of the invention, the alternating plates of the device are formed with integral manifold openings at either of opposite ends thereof. Reinforcing hoops are integrally brazed within the heat exchanger core to provide reinforcement of the manifold sections thereof. The hoops have outer channel openings which are fitted with a strip of reinforcing gusset material. Reinforcing side bars in the central section of the heat exchanger core cooperate with the reinforcing hoops and the integral manifold openings of the plates to provide added structural integrity to the assembled unit.

More specifically, the manifold core units are constructed of a plurality of formed plates and fins brazed together into a complete unit comprising opposing manifolds and a heat exchanging core in a single counter-flow device. The respective end portions of the manifold heat exchanger plates are formed with a peripheral flange which, when joined with the corresponding flange of an adjacent formed tube plate, provides a boundary seal for containing the air fin passages provided by the joined pair of heat exchanger plates. The reinforcing hoops also have inwardly facing channel regions which face the core portion so as to provide communication between the manifold section and the air fin passages.

The formed tube plate and reinforcing hoops are joined by brazing with the flat base portion of an adjacent tube plate in back-to-back relationship, whereby spacing provided between the thus-joined plates allows room for the gas fin passages and seals the manifold sections of the joined heat exchanger plates from the gas passages.

A method is disclosed for providing reinforcement of the integral manifold sections located at opposite ends of a regenerator core fabricated of stacked formed plates and fins. In the first step of the method, a series of tube plates are provided which terminate at oppositely arranged manifold regions which are formed with a continuous manifold opening therein. The manifold openings are made up of an inner curved flange portion of the respective plate which continues circumferentially to form an outer ring region. Each of the manifold regions comprises a base for joining to the base of the manifold region of the next adjacent plate to develop a juncture plane for two adjacent plates. The regenerator core is fabricated of a plurality of such stacked tube plates defining fluid passages therebetween. The tube plates are interleaved respectively with gas fins and air fins in the respective fluid passages A plurality of reinforcing hoops are installed between adjacent plates, the hoops being positioned respectively between pairs of adjacent plates about the manifold regions thereof. The plates are joined together in sealing relationship, each hoop being configured to extend from one adjacent plate to the next and overlap a common juncture of said plates, the hoops being joined in structural reinforcing relationship to the adjacent surfaces of said plates. Each hoop has a generally U-shaped cross section which defines an outwardly facing channel opening for each hoop, and wherein each hoop extends across the juncture plane of the plates and is brazed to the adjacent plates on both sides of the juncture plane and at both the flange portion and at the ring regions of the plates. Preferably, a strip of gusset material is installed within at least a portion of the channel opening of selected ones of the hoops to thereby reinforce the hoops and adjacent plates prior to brazing the assembled regenerator.

Additional objects, features and advantages will be apparent in the written description which follows.

BRIEF DESCRIPTION OF THE DRAWINGS

FIGS. 2A-3 are intended to illustrate the air and exhaust gas flow through the fin and plate assembly of the core module of the invention, the air inlet and exhaust gas flow pattern though the module also being indicated by arrows.

DETAILED DESCRIPTION OF THE INVENTION

The embodiments of the invention presented in the following written description and the various features and advantageous details thereof are explained more fully with reference to the non-limiting examples included in the accompanying drawings and detailed in the description which follows. Descriptions of well-known components and processes and manufacturing techniques are omitted so as to not unnecessarily obscure the principle features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

As has been mentioned previously, the present invention is an improvement in the design and manufacturing technique used in manufacturing a particular type of heat exchanger known in the relevant arts as a regenerator or recuperator. The heat exchanger in question may be utilized, for example, as a part of a gas turbine regenerator used in a gas turbine power plant. The regenerator is used to heat compressor discharge air prior to its entry into the combustion chambers of the power plant, thereby reducing the amount of fuel necessary to bring the combustion gases to the required operating temperatures. Heat is transferred to the compressor discharge air from hot turbine exhaust gases which pass through the regenerator in heat transfer relation with the compressor discharge air. The regenerator includes alternating stacked air and gas channels of the plate-fin type to effect the heat transfer. These types of heat exchangers are generally well known in the relevant heat exchanger arts.

Figure 1:
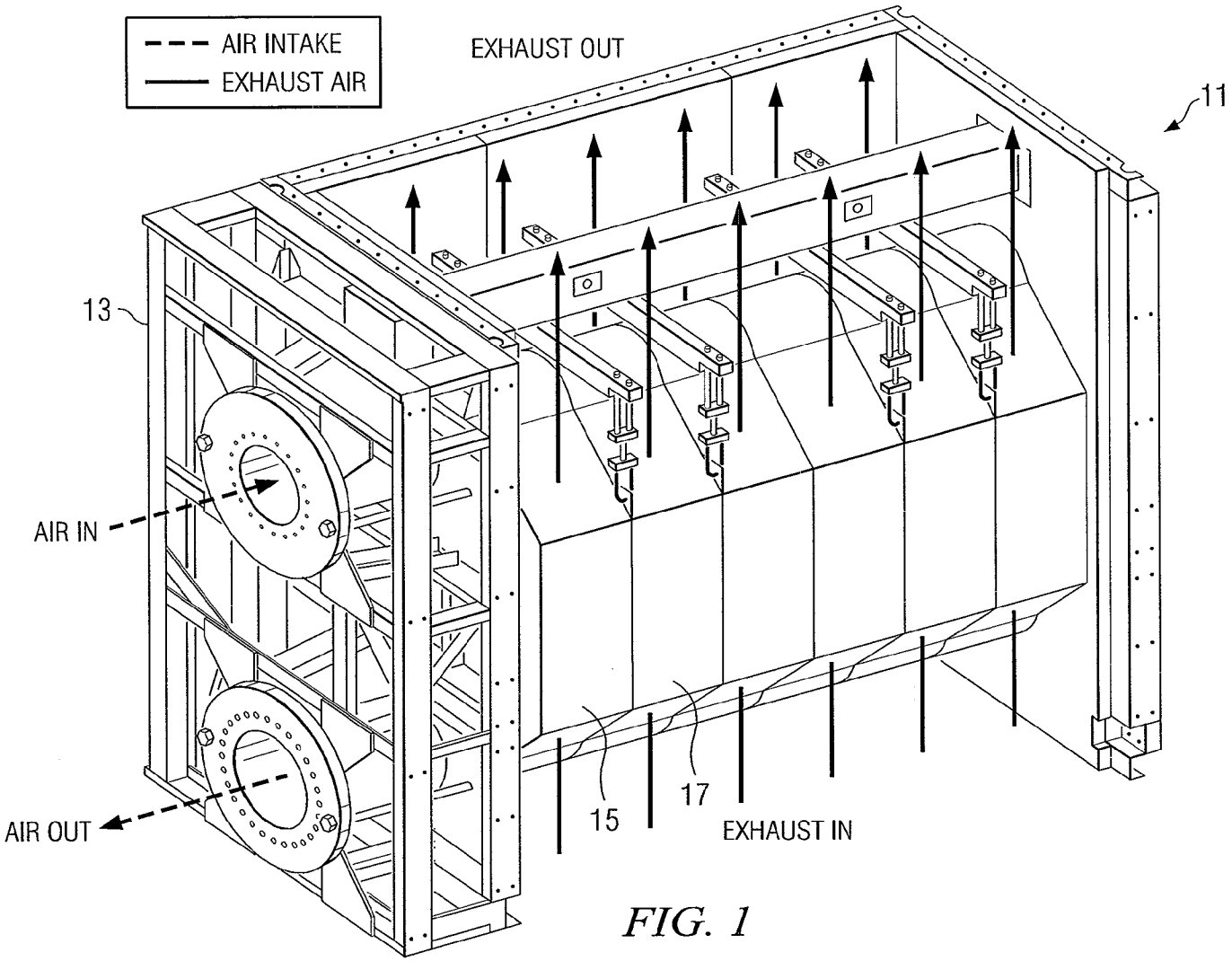
FIG. 1 is a perspective view of a gas turbine regenerator which employs the improved core modules of the invention.

With reference first to FIG. 1 of the drawings, a typical assembled regenerator of the invention is illustrated generally as 11. The regenerator would be used, for example, in a typical arrangement in which a gas turbine is coupled at one end to an air compressor and at the other end to a load. Air is drawn into the compressor at atmospheric pressure 14.7 psi and is discharged from the compressor at, for example, approximately 130 psi and thereafter channeled to the regenerator. Relatively low pressure (14.7 psi), high temperature, gas turbine exhaust gases are channeled to the regenerator from the turbine. Thereafter, the exhaust gases and the compressor discharge air pass in a heat exchange relationship through the regenerator. The exhaust gases are directed to the exhaust stack while the compressor discharge air is channeled, at elevated temperature, to a combustion chamber.

The gas turbine regenerator 11 shown in FIG. 1 has broad arrows indicating respective exhaust gas flows and compressor discharge air flows. In the particular example illustrated, the regenerator includes an outer frame 13 including flanged portions for connecting the regenerator into a gas turbine exhaust duct (not shown). The air and gas flow is shown to be substantially counterflow in the example, but other flow arrangements, which would be apparent to those having skill in the art, are considered to be within the true spirit and scope of the present invention. The regenerator may include any number of core modules, e.g., modules 15, 17, indicated in FIG. 1 of the drawings.

Figure 2:
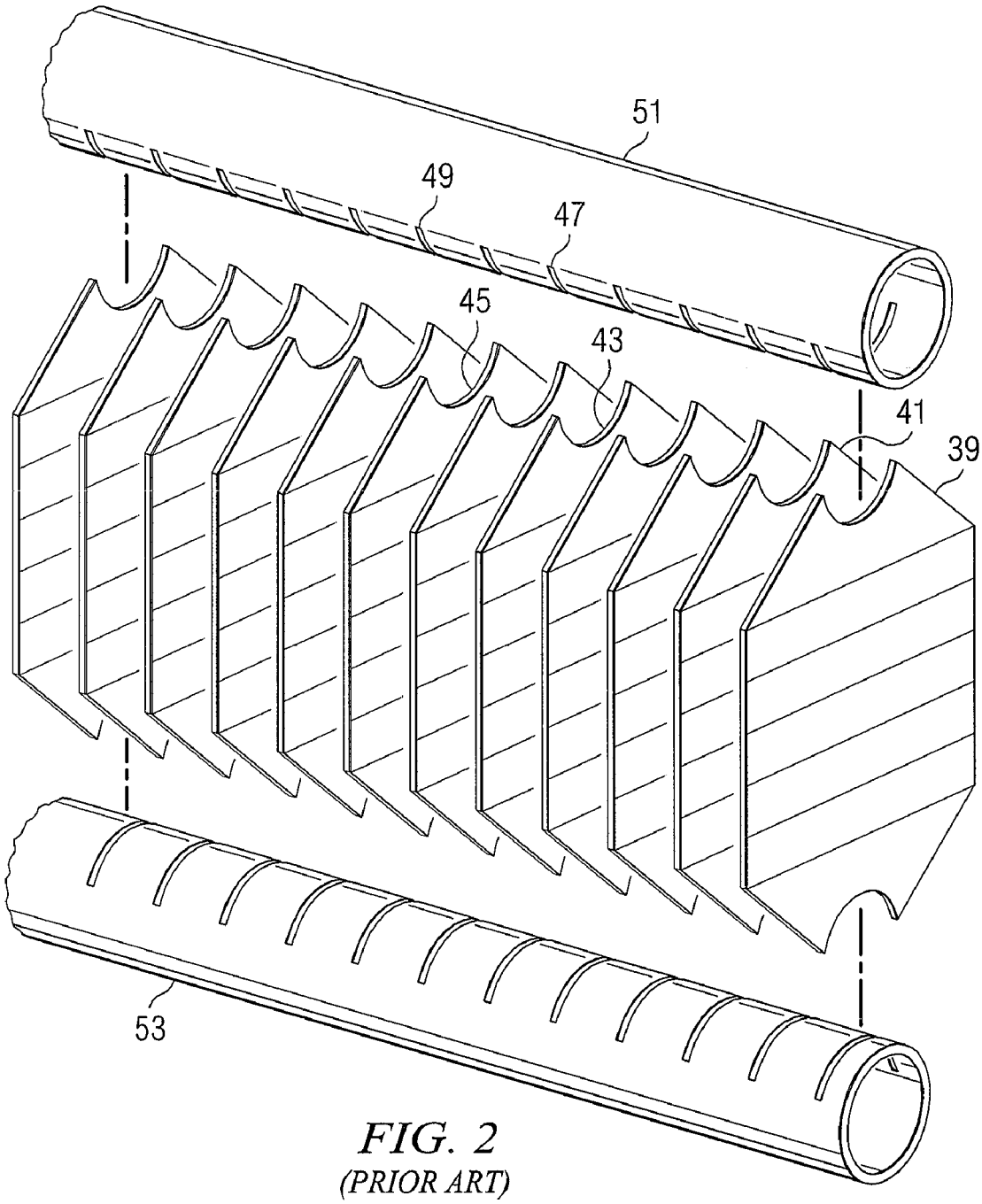
FIG. 2 (PRIOR ART)
FIG. 2 illustrates a prior art core module with the tube plates being welded to opposing cylindrical plenums.
Figure 2A:
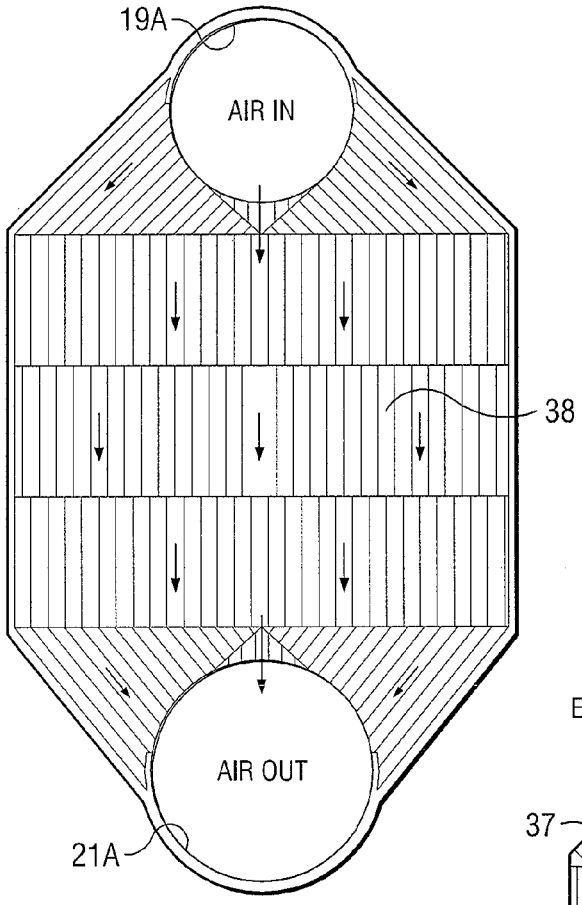
Figure 2B:
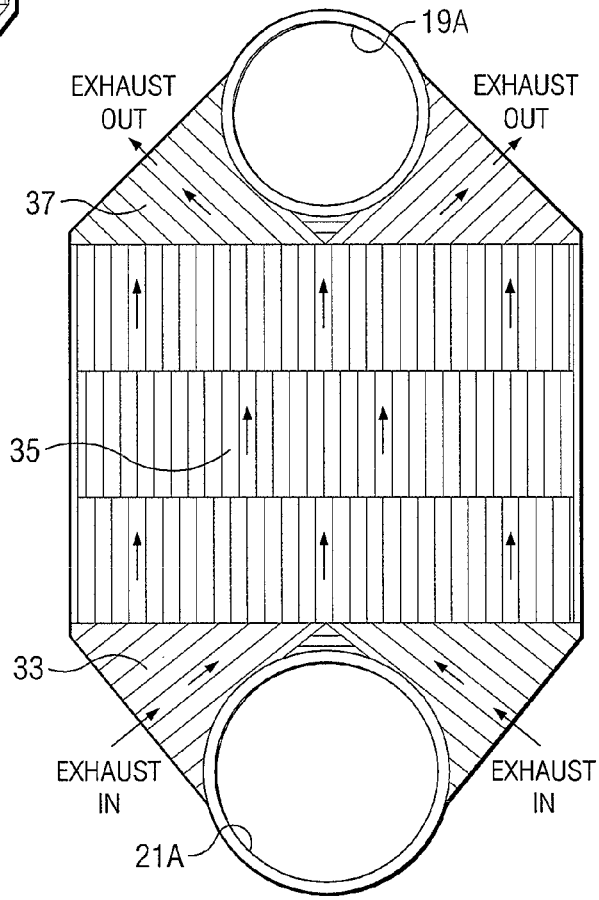
Figure 2C:
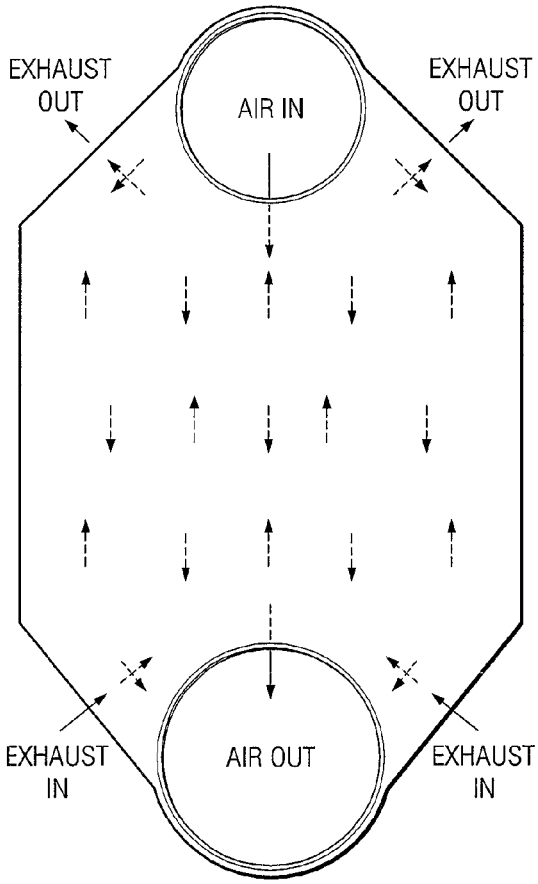
Figure 3:
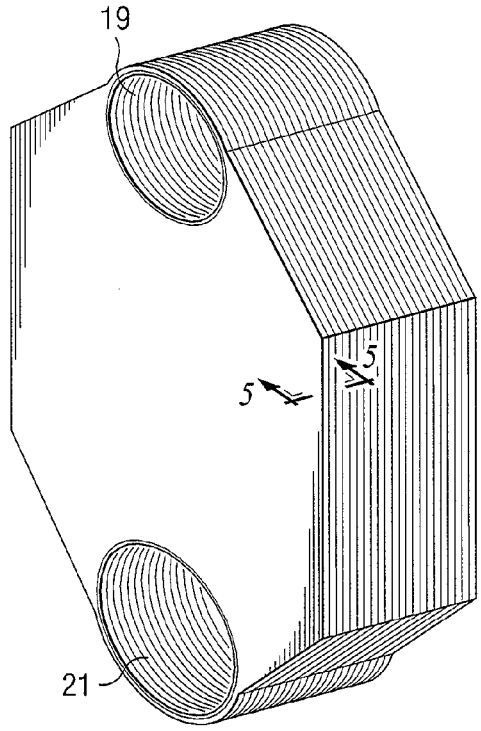

Referring briefly to FIG. 3, a single assembled regenerator module of the invention is shown. The regenerator module includes an air intake manifold 19 and an air outlet manifold 21. As illustrated in somewhat simplified fashion in FIGS. 2A-2C, 3 and 4, the regenerator module is made up of a plurality of formed plates (23 in FIG. 4) interleaved with fins, such as the air fins 25 and the gas fins 27, which serve to direct the air and exhaust gas in alternating adjacent counterflow passages in order to achieve the desired heat transfer effect. End plates 29, 31 are similar to the inner plates 23 except that they are typically formed of thicker sheets, and form the opposite sides of one core module, such as module 15 in FIG. 1. When assembled and brazed to form an integral unit, the formed plates define the respective manifold passages (19 and 21 in FIG. 3) at opposite ends of the central counterflow heat exchanging section of the module and communicating with the air passages thereof.

As indicated by the respective arrows in FIG. 2B, heated exhaust gas from an associated turbine enters the far end of the module and flows through passages 33, flowing around the manifold passage 21A, then through the gas flow passages in the central section 35 and out of the module at the opposite extent 37, flowing around the manifold 19A. At the same time, compressed air from the inlet air compressor for the associated turbine enters the heat exchanger module through the manifold 19A in FIG. 2A, flows through internal air flow passages connected with the manifolds 19A and 21A and through the central heat exchanging region 37, and then flows out of the manifold 21A from whence it is directed to the burner and associated turbine (not shown). In the described process, the exhaust gas gives up substantial heat to the compressed air which is fed to the associated turbine, thereby considerably improving the efficiency of operation of the regenerated turbine system.

The improved method and resulting apparatus produced by the method of the present invention are the result of changes in the method for assembling or providing the inlet and outlet manifold regions (19 and 21 in FIG. 3) of the core module. FIG. 2 is a simplified view of the technique used to assemble a prior art module. The respective tube sheets or banks, e.g., 39, 41, are provided with semi-circular openings 43, 45, which were received within mating slots 47, 49, provided in the oppositely arranged plenums 51, 53, of the manifold regions of the module. The welded juncture between the tube sheets and the plenums presented a potential weak point and possible point of failure of the module in operation.

Figure 4:
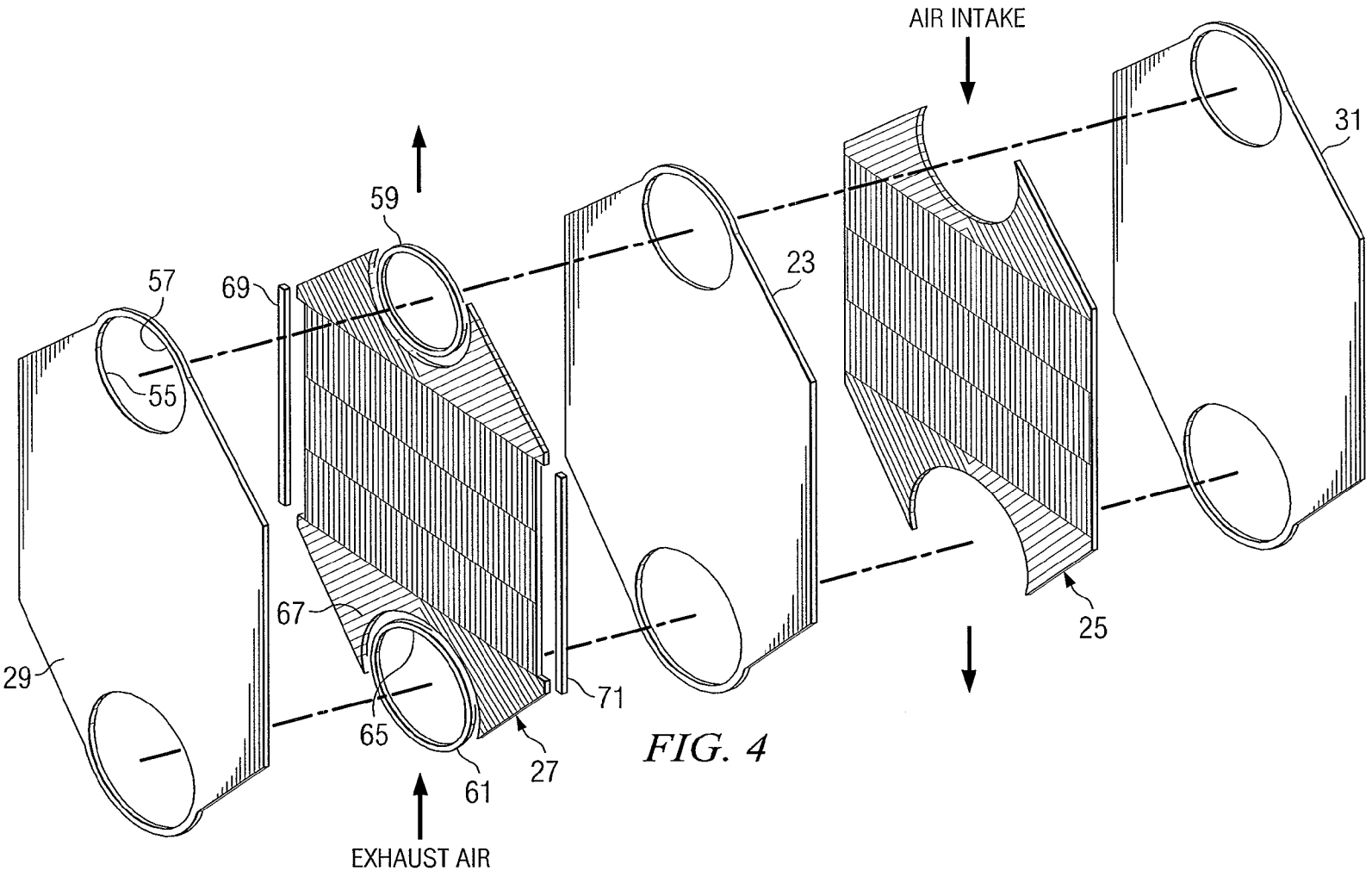
FIG. 4 is an exploded view of the core module of the invention showing the alternating tube plates and assembled fins making up the core module.

With reference now to FIG. 4 of the drawings, it will be appreciated that both the inner and outer plates 23, 29 and 31 that are used to make up the core module under consideration have an integrally formed circular opening at either end thereof. That is, the tube plates terminate at oppositely arranged manifold regions which are formed with a continuous manifold opening therein, the manifold openings being made up of an inner curved flange portion (55 in FIG. 4) which continues, in circumferential fashion, to form an outer ring region 57. Each of the manifold regions of the tube plates forms a base for joining to the base of the manifold region of the next adjacent plate to develop a juncture plane for two adjacent plates. The plates 23, 29 and 31 are thus formed of a uniform piece of material, as by stamping from a sheet of relatively thin metal, such as stainless steel.

As also shown in FIG. 4, a plurality of reinforcing hoops 59, 61, are positioned respectively between pairs of adjacent plates about the manifold regions of the core module. The plates being joined together in sealing relationship, each hoop being configured to extend from one adjacent plate to the next and overlap a common juncture of said plates, said hoops being joined in structural reinforcing relationship to the adjacent surfaces of said plates.

Figure 6:
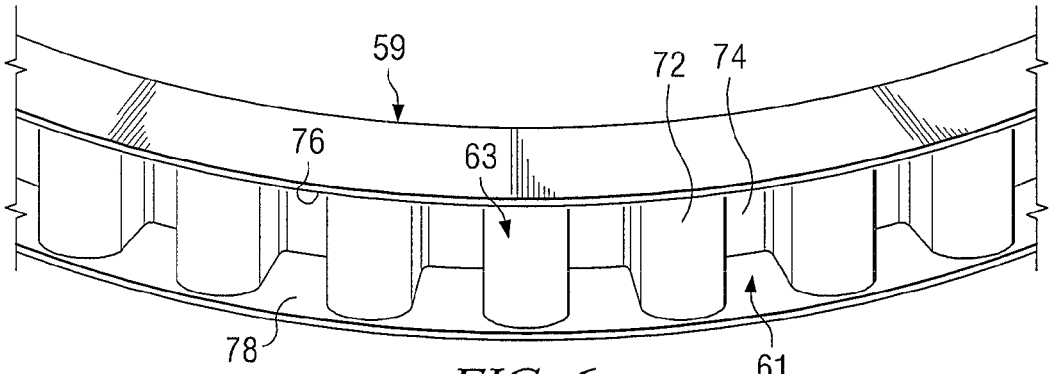
FIG. 6 is a view of a portion of a reinforcing hoop used in the manufacture of the core module of the invention and shows the gusset material used to reinforce the channel ring portions of the core module of the invention.

As perhaps best seen in FIG. 6, each hoop 59 has a generally U-shaped cross section which defines an outwardly facing channel opening 61 for each hoop. Each hoop 59, 61, extends across the juncture plane of the plates and is brazed to the adjacent plates on both sides of the juncture plane and at both the flange portion and at the ring regions of the plates. As can be seen in FIG. 4, each of the substantially circular openings in the manifold plates has a reinforcing hoop associated therewith which is mounted about the openings in the plates. Preferably, the hoops are formed of material thicker than at least some of said plates to provide added resistance to deformation of the plate from internal fluid pressure. As shown in FIG. 6, at least a portion of the channel opening 61 of at least selected ones of the hoops is reinforced by a continuous strip of gusset material 63 which is inserted within the channel opening of the hoops prior to brazing.

The gusset material is preferably a metal strip with an undulating pattern when view from the side. As viewed from the top in FIG. 6, the gusset material forms a series of evenly spaced crests 72 and valleys 74. The side edges of the strip of gusset material are arranged generally perpendicular to the inner walls 76, 78, of the channel region of the hoops, as can be seen in FIG. 6.

It will be appreciated from FIG. 4 that a portion of the channel opening 61 of each of the hoops also forms an inwardly facing channel opening (generally at 65 in FIG. 4) for each hoop, and wherein the inwardly facing channel openings are left vacant to provide a space which affords access between the manifold and selected fluid passages of the regenerator, i.e., for the fins 67. In this way, the fins 67 themselves provide a type of reinforcement for the hoops along the inner circumference of the hoops. As can also be seen in FIG. 4, the regenerator core will also typically include a plurality of reinforcing side bars 69, 71, extending along opposite sides of the assembled plates.

Figure 5:
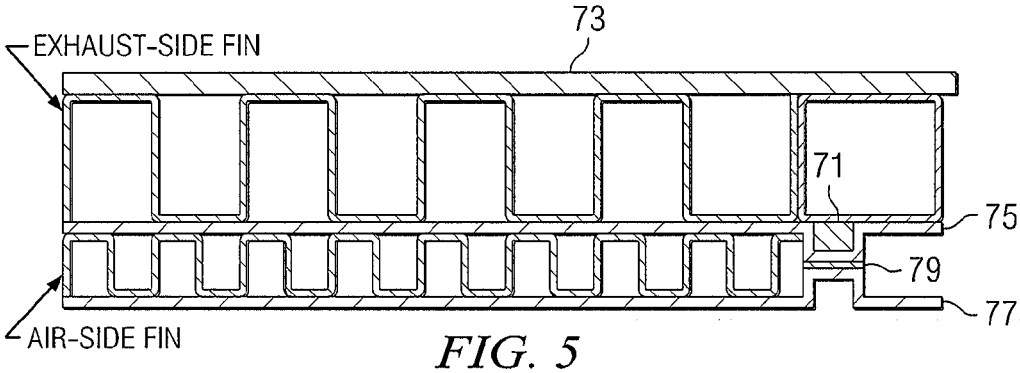
FIG. 5 is a partial, side cross-sectional view of the core module of the invention taken generally along lines V-V in FIG. 3.

With reference to FIGS. 4 and 5, a heat exchanger core module 15, 17, of the invention is assembled by stacking the various inner plates (23 in FIG. 4), air fins 25 and gas fins 27, in repetitive sequence with the inner hoops 59, 61, and side bars 69, 71, between outer plates 29, 31, after which the entire assembly is brazed into a rigid integral unit. As has been mentioned, each outer plate 29, 31 is formed, as by stamping, from a planar sheet of metal with the integral manifold opening formed therein during the manufacture of the tube sheet. The inner plates 23 are formed from planar sheets with ring portions surrounding the manifold openings and offset from the plane of the plate in a first direction. The ring portions of both inner and outer plates are offset by approximately one-half the thickness of the gas fins. The inner plates 23 are also provided with flanges extending along their opposite ends and about the outer portions of the manifold openings outside the ring portions. The flanges are reversely offset from the ring portions—i.e., in a direction from the plane of the plate opposite to that of the U-shaped ring portions—by approximately one-half the thickness of the air fins. Each repetitive segment of the heat exchanger core comprises a pair of tube plates in back-to-back relationship—i.e., with the flanges adjacent each other and the ring portions opposed—together with associated air fins, gas fins, hoops and side bars.

In assembling the heat exchanger components, an outer plate 29 is first laid down with its offset portions facing upward. An outer loop is then placed about each manifold opening in the outer plate and a layer of gas fins and outer side bars is placed thereon in the manner shown in FIG. 4. Side bars side bars 69, 71, extend along adjacent portions of the gas fins 27. An inner plate 23 is next laid down with the ring portion side down, bearing against the offset portion of the outer plate, and the flange side up. A layer of air fins 25 is then placed in position, after which another inner plate (not shown) is laid on top of the assembly, but inverted from the attitude of the previously-placed inner plate 23 so that its flange abut with the flanges of the adjacent plate. Next a layer of gas fins, hoops and side bars is placed in position, followed by the next inner plate of the next segment, etc. This sequence of assembly is repeated until the assembly is completed and the outer hoops, side bars and plate on the upper side are applied to complete the stacked assembly. The assembly is then placed in a brazing oven to braze the entire assembly as a complete unit, brazing compound having been placed prior to assembly on all adjacent surfaces which are to be brazed. During assembly, spot welding is used to affix the various elements in place.

FIG. 5 is a partial sectional view of a portion of the assembled core module of the invention taken generally along lines V-V in FIG. 3. This view shows an outer close out plate 73, with the exhaust-side fins and air-side fins being retained in position by the inner tube sheets 75, 77, respectively. A reinforcing side bar 71 is shown being received within the recessed region of the tube sheet 75. The braze alloy which is used to fuse the respective tube sheets is illustrated as 79 in FIG. 5.

An invention has been provided with several advantages. The arrangement of the manifold pressure containment hoops when used in conjunction with the integral manifold openings provided in the tube sheets, which are integrally brazed along with the central section side bars within the heat exchanger core permits the separate design of these elements for optimum strength and other desirable properties. The materials which are chosen for these reinforcing elements of the design can be provided with increased thickness as compared to the thin tube plates, thereby providing additional strength where needed in the heat exchanger. The gusset material which is used to fill the outer channel openings of the reinforcing hoops helps to bridge that portion between the manifold hoops and the central core section side bars and adds further structural integrity to the unit.

Although there have been shown and described herein particular apparatus for reinforcement of thin plate, high pressure fluid exchangers in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

I claim:

1. A regenerator core for use in a gas turbine regenerator, the regenerator core being fabricated of a plurality of stacked tube plates defining fluid passages therebetween, the tube plates being interleaved respectively with gas fins and air fins in the respective fluid passages, the tube plates terminating at oppositely arranged manifold regions, the improvement comprising:

a series of tube plates terminating at oppositely arranged manifold regions which are formed with a continuous manifold opening therein, the manifold openings being made up of an inner curved flange portion of the respective plate which continues circumferentially to form an outer ring region, each of the manifold regions comprising a base for joining to the base of the manifold region of the next adjacent plate to develop a juncture plane for two adjacent plates;

a plurality of hoops positioned respectively between pairs of adjacent plates about the manifold regions thereof, the plates being joined together in sealing relationship, each hoop being configured to extend from one adjacent plate to the next and overlap a common juncture of said plates, said hoops being joined in structural reinforcing relationship to the adjacent surfaces of said plates;

wherein each hoop has a generally U-shaped cross section which defines an outwardly facing channel opening for each hoop, and wherein each hoop extends across the juncture plane of the plates and is brazed to the adjacent plates on both sides of the juncture plane and at both the flange portion and at the ring regions of the plates; and wherein at least a portion of the channel opening of selected ones of the hoops is reinforced by an undulating strip of metal which is inserted within the channel opening of the hoops prior to brazing.

2. The regenerator core of claim 1, wherein the manifold sections include substantially circular openings in the plates and wherein the hoops are mounted about said openings.

3. The regenerator core of claim 1, wherein the hoops are formed of material thicker than at least some of said plates to provide added resistance to deformation of the plate from internal fluid pressure.

4. The regenerator core of claim 1 wherein the U-shaped cross section of each hoop also forms an inwardly facing channel opening for each hoop, and wherein the inwardly facing channel openings are left vacant to provide a space which affords access between the manifold and selected fluid passages of the regenerator.

5. The regenerator core of claim 1, wherein the regenerator includes a plurality of reinforcing side bars extending along opposite sides of the assembled plates.

6. A method of providing reinforcement for integral manifold sections located at opposite ends of a regenerator core fabricated of stacked formed plates and fins comprising the steps of:

providing a series of tube plates terminating at oppositely arranged manifold regions which are formed with a continuous manifold opening therein, the manifold openings being made up of an inner curved flange portion of the respective plate which continues circumferentially to form an outer ring region, each of the manifold regions comprising a base for joining to the base of the manifold region of the next adjacent plate to develop a juncture plane for two adjacent plates;

installing a plurality of reinforcing hoops between adjacent plates, the hoops being positioned respectively between pairs of adjacent plates about the manifold regions thereof, the plates being joined together in sealing relationship, each hoop being configured to extend from one adjacent plate to the next and overlap a common juncture of said plates, said hoops being joined in structural reinforcing relationship to the adjacent surfaces of said plates;

wherein each hoop has a generally U-shaped cross section which defines an outwardly facing channel opening for each hoop, and wherein each hoop extends across the juncture plane of the plates and is brazed to the adjacent plates on both sides of the juncture plane and at both the flange portion and at the ring regions of the plates; and installing an undulating strip of metal within at least a portion of the channel opening of selected ones of the hoops to thereby reinforce the hoops and adjacent plates prior to brazing the assembled regenerator.

7. A method of assembling a regenerator core comprised of a plurality of formed plates and fins, wherein each plate includes integral manifold sections at opposite ends thereof, comprising the steps of:

laying down a first tube plate formed with opposing manifold regions, each of which includes a continuous manifold opening therein, the manifold openings being made up of an inner curved flange portion of the respective plate which continues circumferentially to form an outer ring region, each of the manifold regions comprising a base for joining to the base of the manifold region of the next adjacent plate to develop a juncture plane for two adjacent plates;

placing a plurality of air fins on said plate in positions to define air flow passages between opposite manifold sections;

placing a second tube plate inverted relative to the first tube plate over the first tube plate and the air fins;

placing a plurality of reinforcing hoops and gas fins over the second tube plate, the gas fins being positioned to define gas flow passages from one end of the regenerator core to the other, the hoops being positioned to surround the respective manifold openings and in surface contact with adjacent flange portion and ring region surfaces;

wherein each hoop has a generally U-shaped cross section which defines an outwardly facing channel opening for each hoop, and wherein each hoop is brazed to the adjacent plates on both sides thereof and at both the flange portion and at the ring regions of the plates;

installing an undulating strip of metal within at least a portion of the channel opening of selected ones of the hoops to thereby reinforce the hoops and adjacent plates prior to brazing the assembled regenerator;

repeating the cycle of steps to develop a stacked assembly of regenerator core elements; and brazing the entire assembly to form an integral unit.

8. The method of claim 7, wherein the manifold openings which are formed in each of the plates of the assembly are integrally formed in the plates at either of opposing ends thereof from the same material as the plates, and wherein the hoops are mounted about said openings.

9. The method of claim 8, wherein the hoops are formed of material thicker than at least some of said plates to provide added resistance to deformation of the plate from internal fluid pressure.

10. The method of claim 9, wherein the U-shaped cross section of each hoop also forms an inwardly facing channel opening for each hoop, and wherein the inwardly facing channel openings are left vacant to provide a space which affords access between the manifold and selected fluid passages of the regenerator.

11. The method of claim 10, wherein the regenerator includes a plurality of reinforcing side bars extending along opposite sides of the assembled plates.

* * * * *